US010974296B2

(12) United States Patent
Knie et al.

(10) Patent No.: US 10,974,296 B2
(45) Date of Patent: Apr. 13, 2021

(54) VOLUME FLOW REGULATING VALVE

(71) Applicant: SMS GROUP GMBH, Düsseldorf (DE)

(72) Inventors: Daniel Knie, Freudenberg (DE); Johannes Alken, Siegen (DE)

(73) Assignee: SMS GROUP GMBH, Düsseldorf (DE)

( * ) Notice: Subject to any disclaimer, the term of this patent is extended or adjusted under 35 U.S.C. 154(b) by 257 days.

(21) Appl. No.: 15/778,463

(22) PCT Filed: Oct. 28, 2016

(86) PCT No.: PCT/EP2016/076029

§ 371 (c)(1),
(2) Date: May 23, 2018

(87) PCT Pub. No.: WO2017/089067

PCT Pub. Date: Jun. 1, 2017

(65) Prior Publication Data

US 2018/0345340 A1 Dec. 6, 2018

(30) Foreign Application Priority Data

Nov. 23, 2015 (DE) ..... 10 2015 223 013.9

(51) Int. Cl.
*B21B 31/07* (2006.01)
*F15B 13/02* (2006.01)

(52) U.S. Cl.
CPC ..... *B21B 31/074* (2013.01); *F15B 13/02* (2013.01)

(58) Field of Classification Search
CPC ..... F16C 32/064; F16C 32/0644; F16C 32/0648; F16C 33/1045–105; F15B 13/02; F15B 2211/329; F15B 2211/428
(Continued)

(56) References Cited

U.S. PATENT DOCUMENTS 2,266,921 A 12/1941 Trautman
2,359,615 A * 10/1944 Browne ..... F02B 37/007 60/600

(Continued)

FOREIGN PATENT DOCUMENTS

DE 1251119 A1 9/1967
DE 2751082 A1 5/1979

(Continued)

*Primary Examiner* — Shelley M Self
*Assistant Examiner* — Jared O Brown
(74) *Attorney, Agent, or Firm* — Lucas & Mercanti, LLP; Klaus P. Stoffel

(57) ABSTRACT

A volume flow regulating valve for controlling the volume flow of a fluid medium in two outflow ducts. The volume flow regulating valve is composed of a cylinder with a dual piston mounted axially displaceably in the cylinder, with a central pressure chamber being formed in the region of the barbell-shaped central piece of the dual piston. Aside from an inlet for the fluid medium, it is also the case that the two outlet ducts are provided at the central pressure chamber. The outlet ducts are arranged on the cylinder with such an axial spacing that—when the dual piston is situated in a central position in relation to the two outlet ducts—the first outlet duct—preferably partially covered by the first piston—and the second outlet duct—preferably partially covered by the second piston—each open up an equal opening cross-sectional area.

9 Claims, 2 Drawing Sheets

(58) Field of Classification Search
USPC ..... 137/118.06, 101
See application file for complete search history.

(56) References Cited

U.S. PATENT DOCUMENTS

| | | | | | |
|---|---|---|---|---|---|
| 2,643,664 | A * | 6/1953 | Willett | G05D 11/006 | 137/101 |
| 2,956,577 | A * | 10/1960 | Hall | F16K 31/363 | 137/101 |
| 3,126,233 | A * | 3/1964 | Royle | F16C 32/0644 | 384/276 |
| 3,370,602 | A * | 2/1968 | Nelson | F15B 13/022 | 137/101 |
| 3,422,650 | A * | 1/1969 | Strance | B21B 31/074 | 72/12.7 |
| 3,616,628 | A | 11/1971 | Kramer | | |
| 4,203,290 | A * | 5/1980 | Burckardt | B62D 5/08 | 137/101 |
| 4,231,441 | A * | 11/1980 | Burckhardt | F15B 13/022 | 137/101 |
| 4,250,909 | A * | 2/1981 | Adams | B62D 5/08 | 137/101 |
| 4,877,057 | A * | 10/1989 | Christensen | A62C 5/02 | 137/625.48 |
| 4,915,510 | A | 4/1990 | Arvidsson | | |
| 5,165,233 | A * | 11/1992 | Betz | F15B 11/162 | 137/101 |
| 5,509,391 | A * | 4/1996 | DeGroot | F02B 75/22 | 123/456 |
| 6,082,398 | A | 7/2000 | Girard et al. | | |
| 6,604,859 | B1 * | 8/2003 | Bonazoli | B21B 31/074 | 29/898.02 |
| 7,484,891 | B2 | 2/2009 | Keller et al. | | |
| 2004/0035202 | A1 | 2/2004 | Strauch | | |
| 2010/0326382 | A1 * | 12/2010 | Miettaux | F01L 9/02 | 123/90.12 |
| 2013/0081438 | A1 * | 4/2013 | Williams | B21B 31/074 | 72/236 |
| 2014/0248007 | A1 | 9/2014 | Corts | | |

FOREIGN PATENT DOCUMENTS

| | | | | |
|---|---|---|---|---|
| DE | 2824538 | A1 | 12/1979 | |
| DE | 10336894 | A | 3/2005 | |
| DE | 10336894 | A1 | 3/2005 | |
| EP | 1452481 | A1 | 9/2004 | |
| EP | 1653132 | B1 | 5/2006 | |
| GB | 815622 | A | 7/1959 | |
| GB | 1312327 | A * | 4/1973 | F15B 21/042 |
| GB | 1312327 | A | 4/1976 | |
| JP | S48036449 | B | 11/1973 | |
| JP | S49010372 | B | 3/1974 | |
| JP | S50108442 | A | 8/1975 | |
| JP | S588876 | A | 1/1983 | |
| WO | 2013048836 | A1 | 4/2013 | |

* cited by examiner

VOLUME FLOW REGULATING VALVE

The present application is a 371 of International application PCT/EP2016/076029, filed Oct. 28, 2016, which claims priority of DE 10 2015 223 013.9, filed Nov. 23, 2015, the priority of these applications is hereby claimed and these applications are incorporated herein by reference.

BACKGROUND OF THE INVENTION

The invention relates to a volume flow regulating valve for controlling the volume flow of a fluid medium in two drain channels. In addition, the invention relates to use of such a volume flow regulating valve in a chock for rotatable mounting of a roll pin of a roll in a roll stand for the rolling of material, preferably metallic material, which is to be rolled.

Volume regulating valves are basically known in the prior art, thus from, for example, EP 1 452 481 A1, EP 1 653 132 B1, GB 815 622 A and DE 2051 949 A1.

The last-mentioned published German specification DE 2051 949 A1, in particular, discloses a volume flow regulating valve according to the preamble of claim 1. Specifically, this specification discloses a volume flow regulating valve with a cylinder having a cavity in which a dumbbell-shaped double piston is guided to be axially displaceable. The double piston consists of a first piston and a second piston, which are connected together by way of a narrowed centre member. A central pressure chamber of the volume flow regulating valve is formed in the region of the narrowed centre member. Arranged at the end faces of the cylinders are springs which extend in the interior of the cavity thereof and between which the double piston is held in a centre setting. A respective first peripheral pressure chamber and second peripheral pressure chamber of the volume flow regulating valve are formed in the region of the springs. A feed channel and a first drain channel respectively for feeding a fluid medium into and draining a fluid medium from the cylinder are provided in the cylinder.

Apart from the described volume flow regulating valves, also known in the prior art—for example from German published specification DE 103 36 894 A1—are chocks as oil film bearings for roll pins of a roll in a roll stand for rolling metallic material to be rolled. The chock disclosed there comprises a bearing bush which spans a cylindrical receiving space for the roll pin. At its inner side the bearing bush has, for example, two hydrostatic pockets which are arranged substantially on a common axial line and which can be supplied with a coolant and/or lubricant by way of a non-return valve and by way of bores extending in the bearing bush or the chock. Throttles in the bores are to ensure optimum hydrostatic journalling of the roll pin even in the case of a skewed position of the roll pin in the bearing bush.

The throttles, also termed restrictors or apertures, fulfil this specific function, but in practice only inadequately. In concrete terms the throttles or restrictors are not suitable for distributing the volume flow of fluid medium or coolant and/or lubricant uniformly to the two hydrostatic pockets, especially not in the case of an inclined setting of the roll pin in the receiving space. Moreover, the throttles or restrictors exhibit high pressure losses, partly above 200 bars.

The German published specification DE2751082 discloses a volume flow regulating valve.

SUMMARY OF THE INVENTION

The invention has the object of developing a known volume flow regulating valve —particularly for use in conjunction with a chock for the mounting of roll pins—in such a way that the volume flow of the fluid medium in the drain channels of the volume flow valve is evened-out even in the case of different pressure ratios in the drain channels.

The term "centre setting" also means symmetrical setting. In the claimed centre setting or symmetrical setting of the double piston the opening cross-section areas freed by the two drain channels are greater than zero, i.e. in this centre or symmetrical setting the fluid medium can always flow out; similarly, the drain channels are not blocked.

This claimed form of the volume flow regulating valve is a constructional prerequisite for fulfilment of the stated object, namely ensuring that the volume flows in the first drain channel and in the second drain channel can be kept to the same amount even in the case of different pressure ratios in the drain channels.

The length L of the centre member of the double piston, is for example, equal to the spacing 2*d* of the centre axes of the first and second drain channels. On the assumption that the first and second pistons of the double piston are respective cylinders having end faces—also termed control edges for the drain channel—extending perpendicularly to the centre member, this claimed length of the centre member ensures that when the double piston is in the centre setting the first drain channel is closed by the first piston of the double piston and the second drain channel is closed by the second piston of the double piston in each instance to the extent of only half.

In order to ensure a volume flow of the same magnitude in the two drain channels even in the case of different pressure ratios in the drain channels the double piston—also termed valve slide—has to be suitably positioned or suitably, i.e. in dependence on the pressure relationships in the drain channels, displaced. According to a second embodiment, for this purpose the invention provides that a first drain channel is present for supplying the static pressure in the first drain channel to the second peripheral pressure chamber and that a second pressure channel is present for supplying the static pressure in the second drain channel to the first peripheral pressure chamber.

In addition, it is provided that a first plunger is mounted in the first peripheral pressure chamber to be axially displaceable for action on that end face of the first piston of the double piston which bounds the first peripheral pressure chamber, wherein the first plunger can be acted on by the total pressure in the first drain channel, and that a second plunger is mounted in the second peripheral pressure chamber to be axially displaceable for action on that end face of the second piston of the double piston which bounds the second peripheral pressure chamber, wherein the second plunger can be loaded by the total pressure in the second drain channel.

Through the two described measures, namely supply of the static and total pressures respectively to the peripheral pressure chambers, the double piston automatically sets itself in correspondence with a force equilibrium resulting from the pressure ratios and preferably also the spring forces in the two peripheral pressure chambers.

Through loading of the peripheral pressure chambers by the stated pressures the double piston is automatically so positioned with the respect to the drain channels that the desired volume flow equal in amount arises in the drain channels.

For the intended use, as described in the following, of the volume flow regulating valve in chocks for mounting backing rolls in roll stands it is advantageous if the volume flow regulating valve is designed for pressures up to 2,000 bars.

The above-mentioned object of the invention is additionally fulfilled by a chock. Accordingly, the chock is characterized in that a volume flow regulating valve in accordance with the invention is provided for regulating the volume flow of the coolant and/or lubricant as fluid medium in the receiving space of the chock. The first drain channel of the volume flow regulating valve is then connected with the first feed channel and the second drain channel is connected with the second feed channel for the feed of coolant and/or lubricant to the receiving space of the chock.

This claimed form of the chock in accordance with the invention advantageously ensures that even in the case of an oblique setting of the roll pin in the receiving space of the chock the volume flows of the coolant and/or lubricant in the two feed channels to the receiving space are always of the same size.

To that extent the advantages of the claimed chock correspond with the advantages mentioned above with respect to the volume flow regulating valve according to the invention.

Further advantageous embodiments of the volume flow regulating valve and of the chock are the subject of the dependent claims.

BRIEF DESCRIPTION OF THE DRAWING

Three figures accompany the description, wherein.

DETAILED DESCRIPTION OF THE INVENTION

Figure 1:
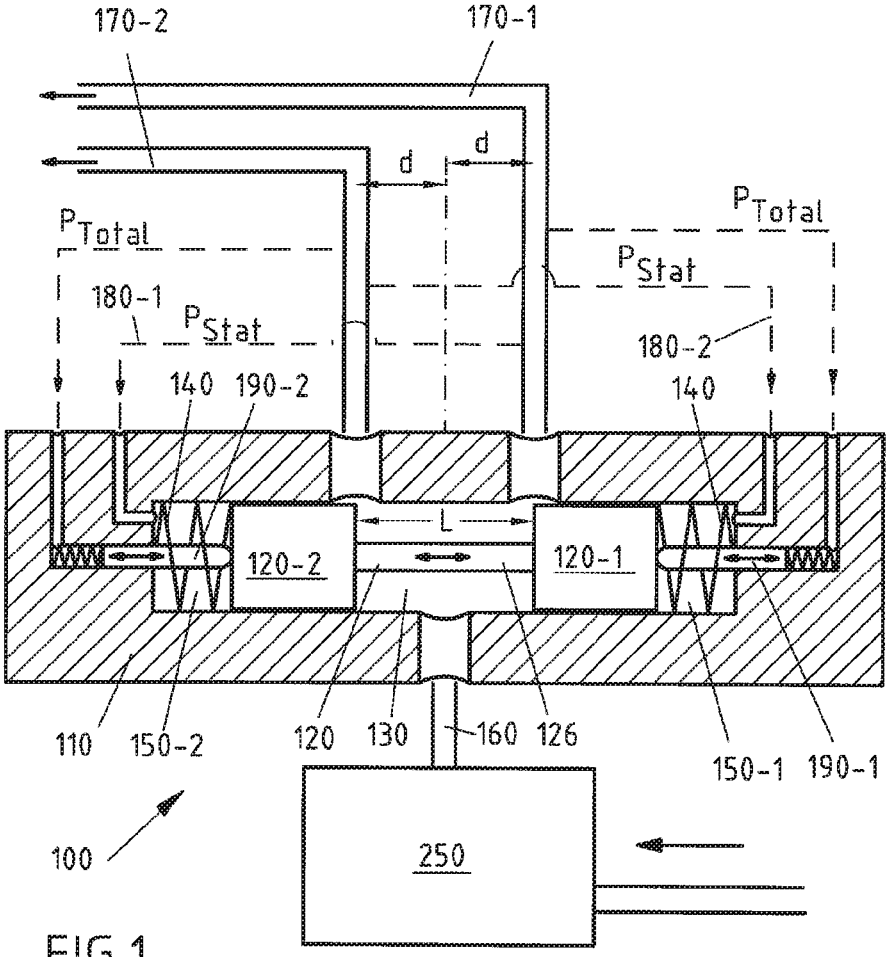
FIG. 1 shows the volume flow regulating valve according to the invention.

The invention is described in detail in the following in the form of embodiments with reference to the mentioned figures. The same technical elements are denoted by the same reference numerals in all figures.

FIG. 1 shows the volume flow regulating valve 100 according to the invention. It substantially consists of a cylinder 110 in which a dumbbell-shaped double piston 120 is mounted to be axially displaceable. The term "axially" is used in the context of the invention for the direction of movement of the double piston. The double piston 120 consists of a first piston 120-1 and a second piston 120-2, which are fixedly connected together by way of a narrowed centre member 126. The first and second pistons to that extent lie as tightly as possible against the cylinder wall. A central pressure chamber 130 of the volume flow regulating valve 100 is formed in the region of the narrowed centre member 126.

A first peripheral pressure chamber 150-1 and a second peripheral pressure chamber 150-2 are formed in the end regions of the cylinder and the pressure chambers are respectively bounded by the end faces, which are remote from the centre member 126, of the first and second pistons. A feed channel 160 is formed at a central point, preferably at half the height of the cavity of the cylinder 110, for the feed of a fluid medium, for example a coolant and/or lubricant, to the central chamber 130 with the help of a pump device 250. A first drain channel 170-1 and a second drain channel 170-2 for draining the fluid medium from the central pressure chamber 130 are formed in the cylinder wall. The first and second drain channels 170-1 and 170-2 have the same axial spacing d from the two sides of the feed channel 160. At the same time, the length L of the centre member 126 of the double piston 120 preferably corresponds with the spacing 2*d* of the centre axes of the first and second drain channels 170-1 and 170-2. In this way it is ensured that when the double piston 120 is disposed in a centre setting the first drain channel 170-1 is closed in such a way by the first piston 120-1, and at the same time the second drain channel 170-2 is also closed in such a way by the second piston 120-2, that the two pistons free the same opening cross-section area.

A respective spring 140 is preferably arranged in each of the peripheral pressure chambers 150-1 and 150-2 so as to hold the double piston in a centre setting, particularly in the case of non-operation of the volume flow regulating valve. However, the springs 140 do not hinder the basic possibility of axial displacement of the double piston 120 within the cylinder 110.

The above-mentioned object of the invention, namely ensuring the same volume flows in the first and second drain channels 170-1 and 170-2 even in the case of different pressure ratios thereat, is fulfilled in particular in that the peripheral pressure chambers 150-1 and 150-2 of the volume flow regulating valve are loaded in suitable manner with specific pressures. In concrete terms, for this purpose the first peripheral pressure chamber 150-1 is loaded with the static pressure in the second drain channel 170-2. In analogous manner, the second peripheral pressure chamber 150-2 is loaded with the static pressure in the first drain channel 170-1. The loading is carried out by way of a respectively provided first pressure channel 180-1 and second pressure channel 180-2.

In addition, a first plunger 190-1 is mounted in the first pressure chamber 150-1 to be axially displaceable for action on the end face, which bounds the first peripheral pressure chamber, of the first piston 120-1 of the double piston. During operation of the regulating valve the first plunger 190-1 is loaded by way of a pressure channel with the total pressure in the first drain channel 170-1. In analogous manner, a second plunger 190-2 is mounted in the second peripheral pressure chamber 150-2 to be axially displaceable for action on the end face, which bounds the second peripheral pressure chamber 150-2, of the second piston 120-2 of the double piston. Again, in analogous manner the second plunger 190-2 is loaded by way of a pressure channel with the total pressure in the second drain channel 170-2. The pressure channels are illustrated in FIG. 1 as dashed lines.

Figure 2:
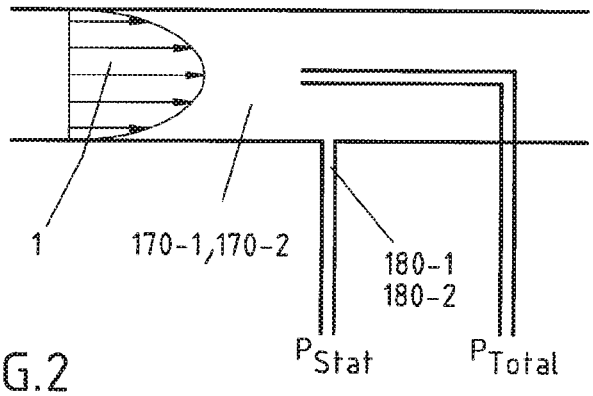
FIG. 2 shows a detail illustration with respect to FIG. 1.

FIG. 2 shows the connection of the pressure channels for the static and total pressure with the first drain channel 170-1 or the second drain channel 170-2. In concrete terms it can be seen that a fluid medium flows in the drain channels 170-1 and 170-2. This medium can be a coolant and/or lubricant, which flows from the central pressure chamber 130 to a consumer, for example a chock for rotatable mounting of a roll pin. In that case, the fluid medium within the drain channels exhibits a speed distribution as can be seen in FIG. 2 by the reference numeral 1. In order to detect the total pressure $p_{Total}$ in the drain channel a pitot probe arranged so that the fluid medium flows into the pitot probe is provided. In addition, provided at the wall of the drain channel 170 is an opening, which represents the end of the first pressure channel 180-1 or second pressure channel 180-2, for detection of the static pressure $p_{Stat}$ in the drain channel.

During operation of the volume flow regulating valve 100 the double piston 120 sets itself automatically or independently in correspondence with a balance of the forces acting thereon. This force equilibrium arises as a consequence of, in particular, the forces acting on the end faces, which are remote from the centre member 126, of the first piston 120-1 and second piston 120-2. The forces are on the one hand the force resulting from the action of the static pressures on the end faces of the first and second pistons and the force exerted by the plungers on the same end faces. In addition, the force exerted by the springs 140 on the same end faces has an influence on the force equilibrium. The force equilibrium determines the axial position of the double cylinder and thus also the ratio of the degree of opening of the first drain channel to the degree of opening of the second drain channel. In correspondence of this ratio of the degrees of opening, the volume flows in the first and second drain channels 170-1 and 170-2 can be set to be equal in amount.

Figure 3:
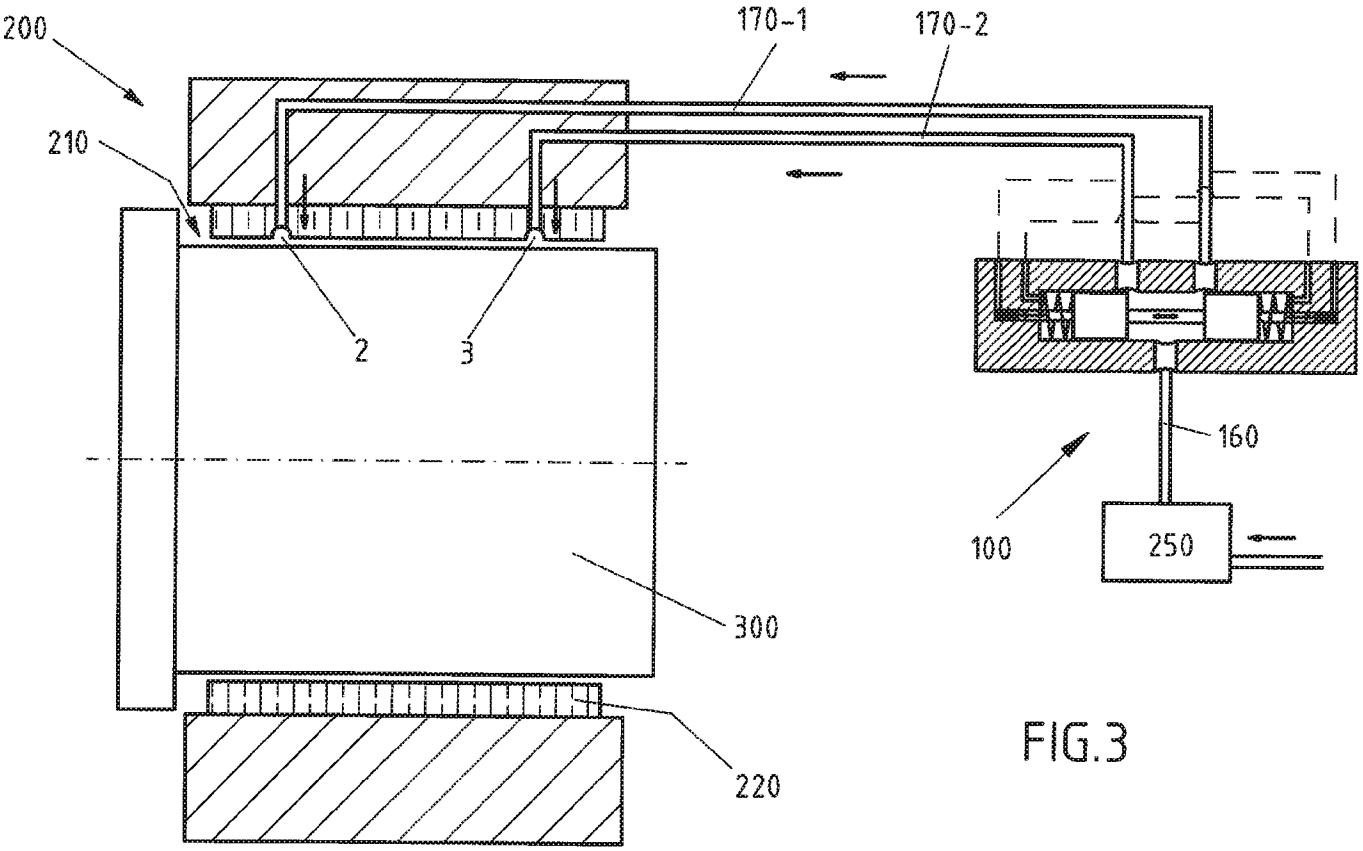
FIG. 3 shows a chock for rotatable mounting of a roll pin of a roll in connection with the regulating valve according to the invention.

FIG. 3 shows the mentioned use of the volume flow regulating valve 100 in accordance with the invention in connection with a chock 200. The chock 200 serves for rotatable mounting of a roll pin 300 of a roll in a roll stand for the rolling of material to be rolled. The chock 200 has a cylindrical receiving space 210 in which the roll pin 300 is rotatably mounted. The cylindrical receiving space is typically spanned by a bearing bush 220 inserted as a wear component into the chock 200. Several, typically two, hydrostatic pockets 2 and 3, through which the coolant and/or lubricant is pumped under high pressure into the receiving chamber 210, more precisely into the annular gap between the bearing bush 220 and the roll pin 300, are formed at the inner wall of the bearing bush 220. For this purpose the first drain channel 170-1 of the volume flow regulating valve, also termed first feed channel, is connected with the first hydrostatic pocket 2 and the second drain channel 170-2 of the volume flow regulating valve, also termed second feed channel, is connected with the second hydrostatic pocket 3.

It is advantageous, particularly for use of the volume flow regulating valve 100 according to the invention in conjunction with the chock 200, if the volume flow regulating valve is designed for pressures up to 2,000 bars.

REFERENCE NUMERAL LIST

1 speed profile
2 hydrostatic pocket
3 hydrostatic pocket
100 volume flow regulating valve
110 cylinder
120 double piston
120-1 first piston
120-2 second piston
126 centre member
130 central pressure chamber
140 spring
150-1 first peripheral pressure chamber
150-2 second peripheral pressure chamber
160 feed channel for central pressure chamber
170-1 first drain channel for fluid medium from the central pressure chamber
170-2 second drain channel for fluid medium from the central pressure chamber
180-1 first pressure channel
180-2 second pressure channel
190-1 first plunger
190-2 second plunger
200 chock
210 cylindrical receiving space
220 bearing bush
250 pump device
300 roll pin
d axial spacing
L length of the centre member
$p_{Total}$ total pressure
$p_{Stat}$ static pressure

The invention claimed is:

1. A volume flow regulating valve, comprising:

a cylinder having a cavity;

a dumbbell-shaped double piston guided in the cavity of the cylinder, the double piston having a first piston and a second piston, the pistons being fixedly connected together by a narrowed center member, wherein a central pressure chamber is formed in the cavity in a region of the narrowed center member, each piston having an end face remote from the narrow center member;

a first peripheral pressure chamber and a second peripheral pressure chamber in the cylinder, the first peripheral chamber being bounded by the end face of the first piston and the second peripheral chamber being bounded by the end face of the second piston; and a feed channel and a first drain channel in the cylinder respectively for feeding a fluid medium to and draining the fluid medium from the central chamber;

a second drain channel in the cylinder for draining the fluid medium from the central pressure chamber, wherein the first drain channel and the second drain channel are arranged at the cylinder with an axial spacing so that when the double piston is disposed in a center setting with respect to the two drain channels the first drain channel and the second drain channel respectively free an equal opening cross-section area;

a first pressure channel provided to supply a static pressure in the first drain channel to the second peripheral pressure chamber, wherein the first pressure channel has an end at an opening in a wall of the first drain channel so as to detect the static pressure in the first drain channel;

a second pressure channel provided to supply a static pressure in the second drain channel to the first peripheral pressure chamber, wherein the second pressure channel has an end at an opening in a wall of the second drain channel so as to detect the static pressure in the second drain channel;

a first pitot tube arranged in the first drain channel so that the fluid medium flows into the first pitot tube and the first pitot tube detects total pressure in the first drain channel;

a second pitot tube arranged in the second drain channel so that the fluid medium flows into the second pitot tube and the second pitot tube detects total pressure in the second drain channel;

a first plunger mounted in the first peripheral pressure chamber to be axially displaceable for action on the end face of the first piston, wherein the first plunger is loaded by the total pressure in the first drain channel; and a second plunger mounted in the second peripheral pressure chamber to be axially displaceable for action on the end face of the second piston, wherein the second plunger is loaded by the total pressure in the second drain channel.

2. The volume flow regulating valve according to claim 1, wherein in the center setting the first piston partially covers the first drain channel and the second piston partially covers the second drain channel.

3. The volume flow regulating valve according to claim 1, wherein the volume flow regulating valve is configured for pressures up to 2,000 bar.

4. The volume flow regulating valve according to claim 1, further comprising a respective spring arranged in each of the first and second peripheral pressure chambers so as to hold the double piston in the center setting and so that the double piston is axially displaceable.

5. A chock for rotatable mounting of a roll pin of a roll in a roll stand for a rolling material to be rolled, comprising:

a cylindrical receiving chamber for receiving the roll pin;

a first feed channel and a second feed channel for feed of coolant and/or lubricant to the receiving chamber; and an element for regulating volume flow of the coolant and/or lubricant in the first and second feed channels; wherein the element is a volume flow regulating valve according to claim 1; and the first drain channel of the volume flow regulating valve is connected with the first feed channel and the second drain channel is connected with the second feed channel.

6. The chock according to claim 5, wherein at least one of the first and second feed channels communicates with a hydrostatic pocket formed at an inner wall of the receiving chamber for the roll pin.

7. The chock according to claim 6, further comprising a bearing bush that spans the receiving space as a wear component; wherein the hydrostatic pocket is formed at an inner side of the bearing bush.

8. The chock according to claim 5, further comprising a pump for feeding the coolant and/or lubricant via the feed channel for feeding the fluid medium to the central pressure chamber of the volume flow regulating valve.

9. The chock according to claim 8, wherein the pump feeds the coolant and/or lubricant at pressures up to 2,000 bar.

* * * * *